United States Patent [19]

Etra

[11] 4,109,140

[45] Aug. 22, 1978

[54] DIVER'S CONTROL AND INDICATION APPARATUS

[76] Inventor: Richard Henry Etra, 67-40 Yellowstone Blvd., Forest Hills, N.Y. 11375

[21] Appl. No.: 788,749

[22] Filed: Apr. 19, 1977

[51] Int. Cl.[2] ..... G07C 1/10

[52] U.S. Cl. ..... 235/92 MT; 58/145 R; 235/92 T; 235/92 DP; 235/92 R

[58] Field of Search ..... 235/92 MT, 92 T, 92 DP, 235/92 GA; 58/145 R, 152 R; 73/291

[56] References Cited

U.S. PATENT DOCUMENTS

| | | | |
|---|---|---|---|
| 3,475,902 | 11/1969 | Wessel | 58/152 R |
| 3,505,808 | 4/1970 | Eschle | 58/126 |
| 3,696,610 | 10/1972 | Charbonnier | 58/145 R |
| 3,919,888 | 11/1975 | Muster et al. | 73/291 |
| 3,992,949 | 11/1976 | Edmondson | 58/145 R |

*Primary Examiner*—Joseph M. Thesz

[57] ABSTRACT

Improved diver's apparatus is disclosed for automatically determining and displaying the depth and duration of a dive, as well as the allowable bottom time remaining for the dive to permit a safe ascent without going through decompression stages. For longer bottom times, the depth and duration of each decompression stop during ascent is automatically determined and displayed to the diver, an indication is provided when a stop is reached and the duration of the stop is timed. For repetitive dives the surface time between dives is used, in conjunction with the depth and duration of the previous dive, to determine the equivalent bottom time for beginning the succeeding dive.

18 Claims, 7 Drawing Figures

DIVER'S CONTROL AND INDICATION APPARATUS

BACKGROUND OF THE INVENTION

This invention relates to diver's control and indication apparatus and, more particularly, to such apparatus which may be worn or carried by a diver for providing certain time and depth calculations and indications relative to an underwater dive.

Growth of the sport of underwater diving, along with the requirements of professional diving, has increased the urgent need for reliable control and indication apparatus for use by a diver. As is well known, a diver is supplied with air at ambient pressure and as the diver submerges the pressure increases such that greater quantities of gases in the supplied air are absorbed by the diver. Of particular concern is nitrogen which, when dissolved in the diver's body under pressure and then allowed to escape rapidly such as by a rapid decrease in pressure during ascent, can lead to severe physiological disorders, referred to generally as the bends or decompression sickness.

Consequently, to minimize these difficulties, limits have been established by various authorities, including the United States Navy, which specify how long a diver may safely remain at a particular depth and then ascend without going through decompression. However, it is also known that if these no-decompression limits are exceeded, the diver can still safely ascend to the surface in slow, controlled decompression stages so as to gradually release excess nitrogen from the body. Thus limits have also been established for decompression stages to be observed as a function of the time and depth of a dive. In addition, diving limits have been established for repetitive dives based upon the duration of previous dives and surface times between dives, the former accounting for previously absorbed nitrogen and the latter accounting for gas released from the diver's body while on the surface.

Heretofore, attempts have been made to provide a diver with various watch-type instruments, depth gauges and the like based generally on one or more of the established limits just mentioned. These attempts have been less than satisfactory since they typically have suffered from one or more disadvantages or shortcomings such as requiring the use of several separate pieces of equipment, requiring difficult underwater manipulations, restricting the diver's freedom of movement, or providing imprecise or difficult to interpret readings.

Further limitations encountered with existing arrangements relate to the quantity and type of diving data that can be handled and indicated to the diver economically.

Accordingly, a need exists for improved diver's control and indication apparatus which will economically and accurately provide various time and depth calculations and indications, and which will provide for greater flexibility and ease of use than known arrangements.

SUMMARY OF THE INVENTION

In an illustrative embodiment of diver's control and indication apparatus according to my invention, the peak depth attained during a dive is used to determine the maximum allowable time for the dive and thus, in conjunction with the time elapsing during the dive, to determine automatically and provide an indication of the allowable time remaining. Indications of the elapsed diving time and of the dive depth may also be displayed advantageously to the diver, along with suitable alarms if the allowable dive time runs out or if a predetermined dive depth is exceeded. Further, in accordance with one aspect of the invention, the diver's apparatus tracks the rate of ascent from a dive and provides an alarm if a predetermined rate is exceeded.

According to another aspect of the invention, the time elapsing while a diver is on the surface between dives is used, in conjunction with the depth and elapsed time of the previous dive, to determine an appropriate surface interval credit and thus equivalent bottom time for reducing the diving time of a succeeding dive.

A further aspect of another illustrative embodiment of the invention is directed to determining the successive decompression stops for safely ascending from a dive when the allowable dive time is exceeded. An indication is provided when each decompression stop is reached by the diver and when the required time has elapsed at a particular decompression stop.

BRIEF DESCRIPTION OF THE DRAWING

The above and other objects and features of my invention may be fully apprehended from the following detailed description and the accompanying drawing, in which.

GENERAL DESCRIPTION

The illustrative embodiments described herein assume the use of dive limit data such as established by the United States Navy and published, for example, as Tables 1–5 through 1–8 at pages 210–213 of "The New Science of Skin and Scuba Diving" by the Council for National Cooperation in Aquatics (Association Press of N.Y.C., 1968). However, it will be appreciated that other accepted tables for determining no-decompression and decompression dive limits can be used if desired.

A no-decompression table, such as above-mentioned Table 1–6, shows for various dive depths the allowable diving times, usually referred to as bottom times, which permit a diver to surface directly at 60 feet per minute or less with no decompression stops. Longer bottom times require the use of a decompression table, such as above-mentioned Table 1–5, which gives the decompression stages and durations which must be observed for a safe ascent. For depths of 30 feet or less there is assumed to be no limit to the allowable bottom time. Greater depths are typically indicated in increments of 5 feet with corresponding allowable bottom times ranging from approximately 5 hours at 35 feet down to 5 minutes at 190 feet.

Additional tables, including Tables 1–7 and 1–8 in the above publication, are used to determine the allowable bottom times for repetitive dives. Depending upon the depth and duration of the previous dive and the interval of time on the surface between dives, an equivalent elapsed bottom time can be determined for starting a successive or repetitive dive to a particular depth. This, in turn, permits determination of the allowable bottom time remaining for the successive dive with no decompression stops. For convenience in making these determinations, the tables are typically divided into repetitive dive groups, such as groups A through O in the above publication. Dives following surface time intervals of more than 12 hours since the previous dive are not considered repetitive dives, and thus the tables are used as if no previous dive had occurred.

Figure 1:
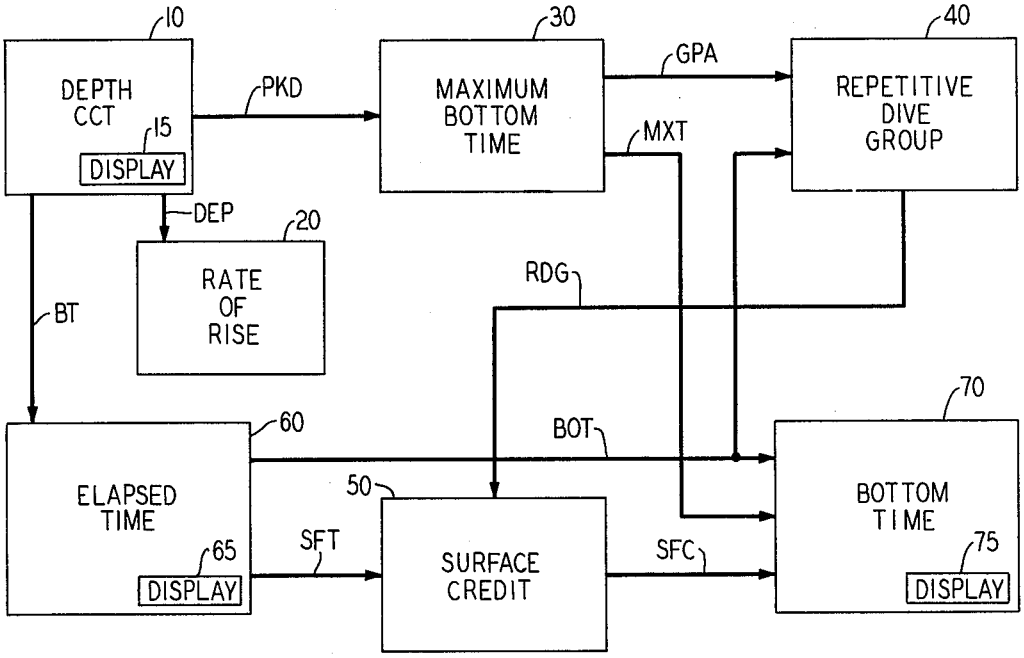
FIG. 1 is a functional block diagram of diver's control and indication apparatus in accordance with the principles of my invention.

Broadly, the functional block diagram of the present invention shown in FIG. 1 contemplates the storage and use of encoded representations of the data contained in the above-mentioned dive limit tables for diving without decompression stops. No-decompression limit and repetitive dive group data from Table 1–6 is stored in maximum bottom time block 30 and repetitive dive group block 40. Surface time credit data from Table 1–7 is stored in surface credit block 50. The data in Table 1–8 for determining the equivalent bottom time in light of the surface credit, and thus the remaining allowable bottom time for a repetitive dive, is stored in bottom time block 70.

In operation during a dive, the greatest or peak depth attained is determined by depth circuit 10 and is used via path PKD to address the no-decompression limit data in maximum bottom time block 30 to determine the maximum bottom time allowed for that depth, a representation of which is directed over path MXT to bottom time block 70. Elapsed time block 60 is enabled by depth circuit 10 over lead BT to keep track of the time elapsing during the dive and to extend a representation thereof over path BOT to bottom time block 70. The difference between the maximum allowable bottom time and the elapsed bottom time is determined in bottom time block 70 and is displayed via display 75 as the remaining bottom time allowed for the particular dive.

The peak dive depth on path PKD is used also, illustratively via block 30 over path GPA, along with the elapsed bottom time on path BOT to determine the repetitive dive group for succeeding dives. A representation of the repetitive dive group is extended over path RDG by block 40 to surface credit block 50. Subsequently while the diver is on the surface between dives, as indicated by depth circuit 10 over lead BT, elapsed time block 60 is enabled to keep track of the surface time elapsing since the previous dive. A representation of the elapsed surface time is directed over path SFT to block 50 which, in conjunction with the repetitive dive group determined from the previous dive, is used to determine an appropriate surface interval credit for a succeeding dive. A representation of the surface interval credit is extended over path SFC to bottom time block 70 and is used to determine the equivalent bottom time for beginning the succeeding dive. During such succeeding dive the equivalent bottom time is subtracted, along with the elapsed bottom time for the succeeding dive on path BOT, from the maximum allowable time for the dive on path MXT to determine and display the remaining bottom time for the succeeding dive.

During ascent from a dive, the rate of rise is tracked by rate of rise block 20 in response to periodic depth indications from depth circuit 10 over path DEP. An alarm indication is provided by block 20 if a predetermined rate of rise (e.g., 60 feet per minute) is exceeded.

Other visual display indications that may be provided advantageously to a diver include the dive depth via display 15 in depth circuit 10 and the elapsed bottom time via display 65 is elapsed time block 60. In addition, various alarm and other indications can be provided, such as an excessive depth indication via depth circuit 10 when the dive exceeds a predetermined maximum depth (e.g., 190 feet), an insufficient surface time indication via elapsed time block 60 when not enough surface time has elapsed to permit a repetitive dive, and an excessive bottom time indication via bottom time block 70 when the allowable bottom time for a dive has been exceeded. An indication can also be provided by bottom time block 70 when only a limited amount of allowable bottom time (e.g., 5 minutes) is remaining.

DETAILED DESCRIPTION

Figure 2:
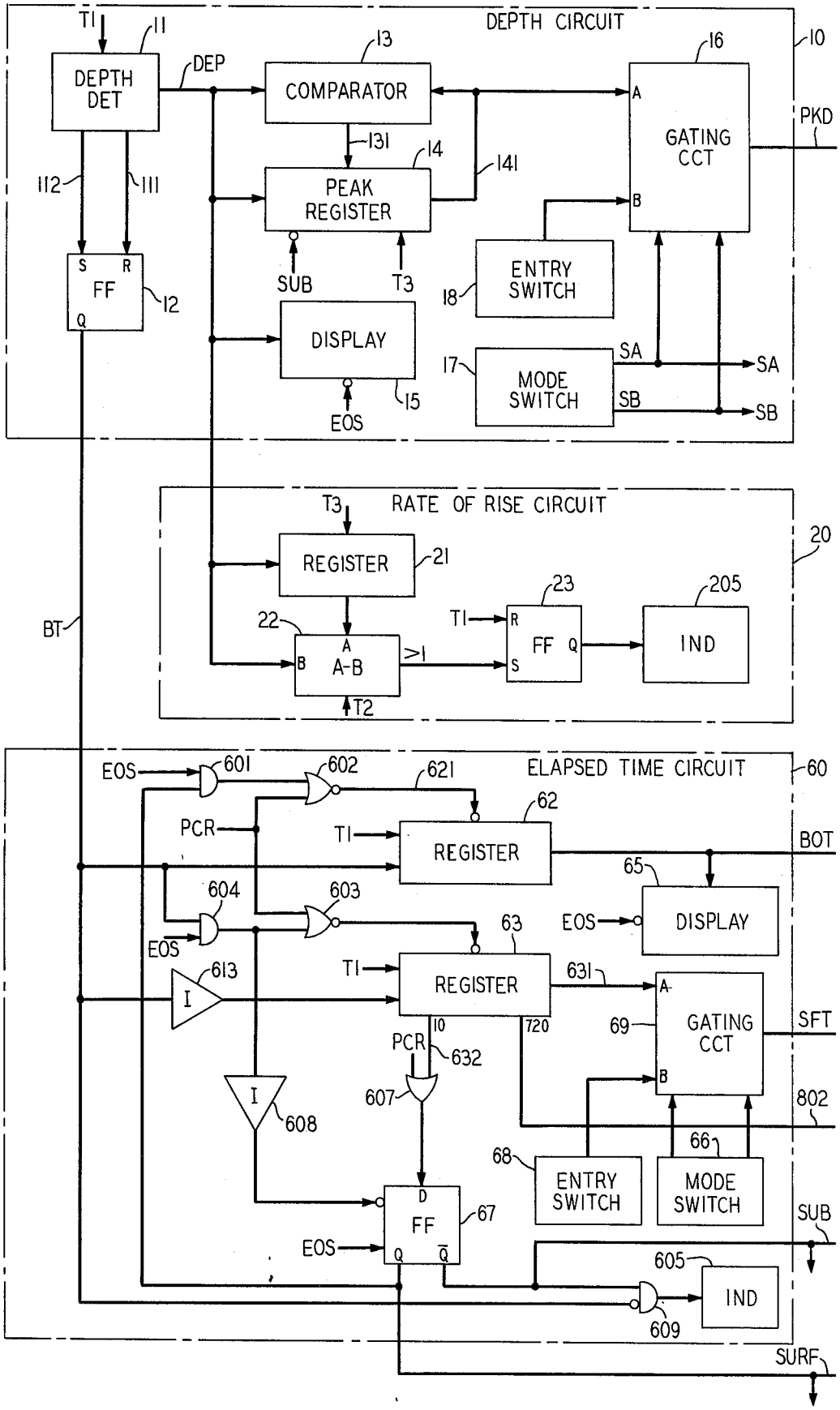
FIGS. 2–4, when arranged as shown in FIG. 5, comprise a detailed block diagram of an illustrative embodiment of the apparatus shown in FIG. 1.
Figure 3:
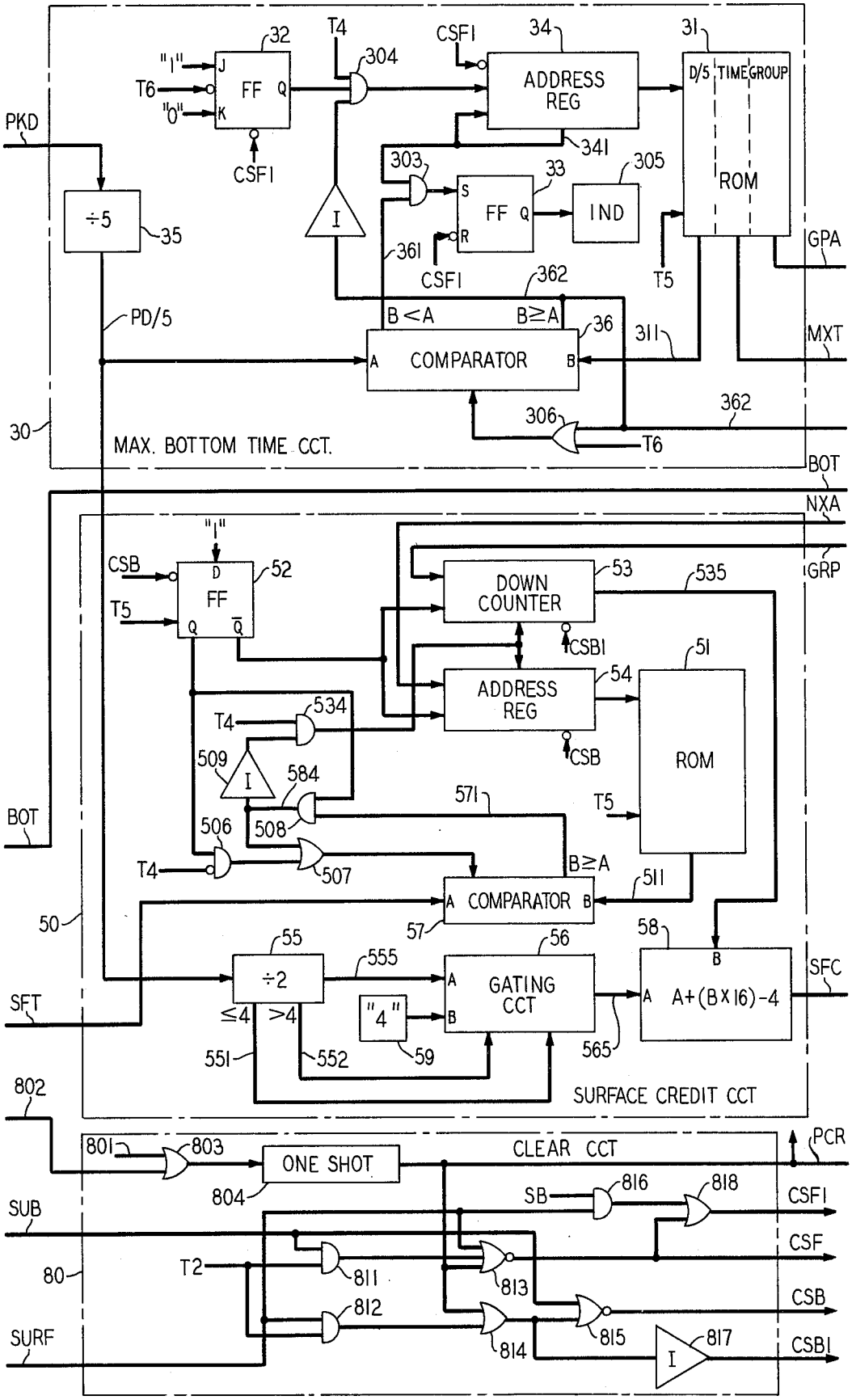
Figure 4:
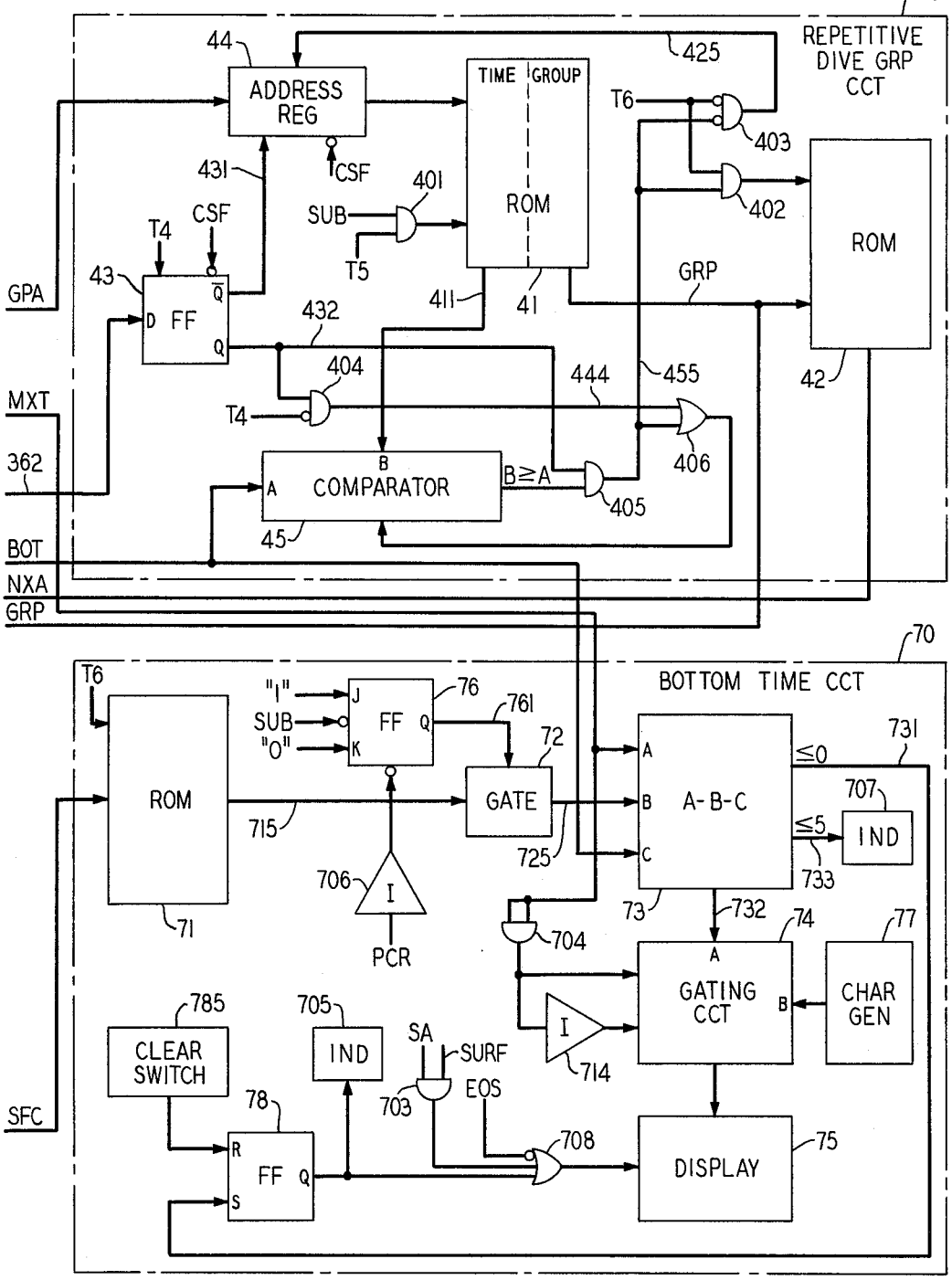
Figure 4:
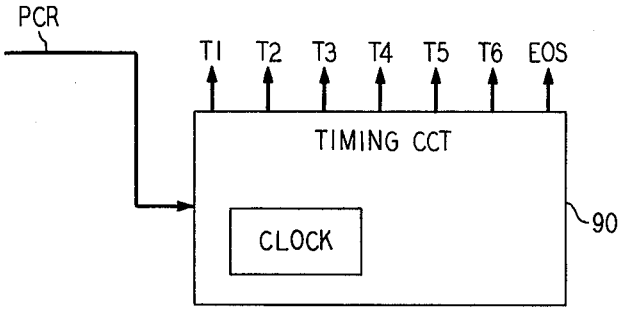
Figure 5:
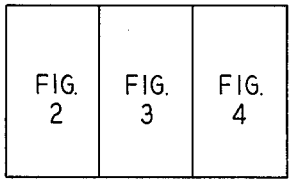

In the specific illustrative embodiment of the invention shown in greater detail in FIGS. 2–4, elements corresponding generally to those in FIG. 1 are indicated by like designations. Conventional read only memory (ROM) circuits are employed for storage of the various dive limit table representations.

For example, ROM 31 may contain 22 dive depth word entries each including, for the particular depth, the maximum allowable bottom time and an associated repetitive dive group word address in ROM 41. Since all depths are assumed to be in increments of 5 feet, the depth divided by five (D/5) may be used in ROM 31 to reduce the number of bits required for each entry. An arbitrary allowable bottom time somewhat greater than 5 hours (e.g., 384 minutes) may be stored in each depth word corresponding to depths of less than 35 feet.

Similarly, ROM 41 may illustratively contain 140 repetitive dive group words each including the maximum bottom time and group identity for a particular repetitive dive at a particular depth. For simplicity, all dive groups and bottom times associated with a particular depth are assumed to have contiguous addresses in ROM 41, ordered in order of increasing bottom time magnitudes. Consequently, the repetitive dive group word address associated with a particular depth in ROM 31 need only contain the address of the first dive group in ROM 41 for that depth, and subsequent dive groups for that depth can be accessed by simply incrementing the address.

The 15 possible group identities, corresponding to repetitive dive groups A through O, may be represented numerically (i.e., 0–14 respectively) in ROM 41 and then translated via a 15 word table in ROM 42 into a surface interval word address in ROM 51. This translation reduces the length of the 140 words in ROM 41. ROM 51 is assumed to contain 120 surface interval words each specifying a particular surface interval credit for a particular repetitive dive group. All surface interval words for a particular dive group may have contiguous addresses in ROM 51 ordered in order of increasing surface interval credit times. The address provided by ROM 42 thus defines the minimum surface credit time stored in ROM 51 for the particular dive group, and successive surface credit times may be accessed by incrementing the address. The last address for each dive group specifies the maximum surface interval credit time of 12 hours.

For each of the 15 repetitive dive groups, there are 16 bottom time words stored in ROM 71. Each bottom time word specifies the equivalent bottom time at a particular depth (ranging from 40 feet in increments of ten feet up to 190 feet) for a particular repetitive dive group. All bottom time words associated with a particular dive group are assumed to have contiguous addresses ordered in order of decreasing equivalent bottom time (i.e., in order of increasing repetitive dive depth).

Operation of the apparatus shown in FIGS. 2–4 is initiated by applying power to start lead 801 in clear circuit 80, and is subsequently reinitiated by a signal on lead 802 when surface time has exceeded 12 hours, OR gate 803 thereby enabling one shot circuit 804 to generate a clear pulse on lead PCR. The pulse on lead PCR results in the clearing and initializing of the various registers and circuits, and timing circuit 90 is enabled thereby. Thus, the pulse on lead PCR clears bottom time register 62 through NOR gate 602, clears surface time register 63 through NOR gate 603, sets flip-flop 67 through OR gate 607 to provide a signal on lead SURF, clears flip-flop 76 through inverter 706 to disable gate 72, and generates signals on clear leads CSF, CSF1, CSB and CSB1 via obvious paths through NOR gate 813, OR gate 818, OR gate 814, NOR gate 815 and inverter 817. The signals on leads CBS and CSB1 clear flip-flop 52 and counters 53 and 54 in surface credit circuit 50; the signal on lead CSF clears flip-flop 43 and counter 44 in repetitive dive group circuit 40; and the signal on lead CSF1 clears flip-flops 32 and 33 and counter 34 in maximum bottom time circuit 30.

Figure 6:
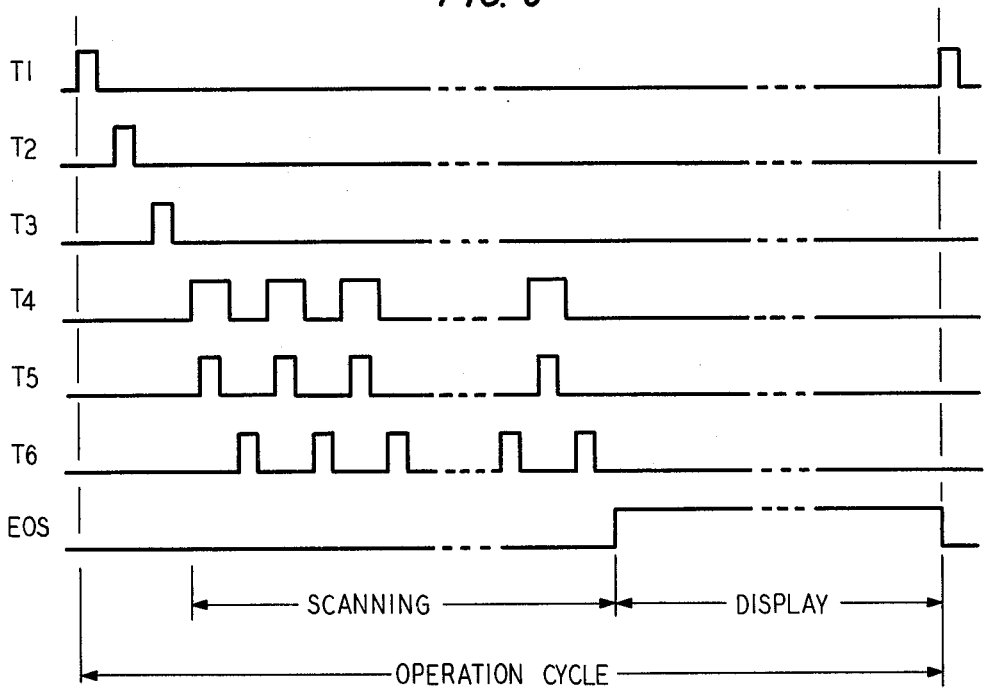
FIG. 6 depicts various timing and scanning signals that may be employed in the operation of the illustrative embodiment of FIGS. 2–4.

Upon being enabled by the signal on lead PCR, timing circuit 90 generates individual timing signals in sequence on leads T1, T2, and T3 once each operation cycle. illustratively once each second, as depicted in FIG. 6. The timing signal on lead T3 is followed by individual sequences of 50 scanning signals on each of leads T4, T5 and T6 at a frequency which may be on the order of 500 Hz. Upon termination of the last scanning signal on lead T6, an end-of-scan signal appears on lead EOS. Displays 15, 65 and 75 may be advantageously blanked during the scanning signals, such as via lead EOS, but since the scanning signals occur only during a small fraction of each operation cycle the displays will appear to be lighted continuously.

The first timing signal of each one second operation cycle, on lead T1, is extended to elapsed time circuit 60 to increment the appropriate one of bottom time and surface time registers 62 and 63, depending upon whether the diver is submerged or surfaced. If the diver is submerged (i.e., depth is greater than zero) depth circuit 10 provides a signal on lead BT to enable the incrementing of register 62; otherwise, register 63 is enabled over lead BT through inverter 613. Elapsed bottom time in register 62 is extended over path BOT to display 65 and to circuits 40 and 70. Elapsed surface time in register 63 is extended on path 631 through gating circuit 69 over path SFT to surface credit circuit 50. The timing signal on lead T1 also strobes depth detector 11 to provide a digital representation of the current depth on path DEP to display 15 for the duration of the operation cycle. Depth detector 11 may comprise any suitable arrangement for providing a digital representation of depth, such as a transducer connected in a bridge arrangement with the output converted to digital form via an analog-to-digital converter. Display 15, as well as displays 65 and 75, may comprise conventional liquid crystal or light-emitting diode display apparatus.

The second timing signal of each operation cycle, on lead T2, essentially clears all working registers and counters with the exception of peak register 14, bottom time register 62 and surface time register 63. In particular, if the diver is submerged, as indicated by flip-flip 67 over lead SUB, AND gate 811 is enabled to extend the timing signal over leads CSF and CSF1. If the diver is surfaced, as indicated over lead SURF, AND gate 812 is enabled to extend the timing signal over leads CBS and CSB1.

The third timing signal, on lead T3, clocks peak register 14 for updating it each cycle in the manner described below. Thereafter, the scanning signals on leads T4, T5 and T6 are directed to circuit 30, 40, 50 and 70, followed by an end-of-scan signal on lead EOS to circuits 60 and 70. In circuit 60, the end-of-scan signal on lead EOS clears bottom time register 62 via AND gate 601 and NOR gate 602 if a signal appears on lead SURF, or clears surface time register 63 via AND gate 604 and NOR gate 603 if a signal appears on lead BT. In the latter case, flip-flop 67 is also cleared via AND gate 604 and inverter 608.

Consequently, assuming the diver is on the surface when operation is initiated, the depth indicated by detector 11 on path DEP will be "0," flip-flop 12 will be cleared via lead 111 to enable surface time register 63, and the remaining bottom time will be indicated by display 75 as unlimited. To indicate the unlimited bottom time while the diver is on the surface (or when the diver is submerged to a depth less than 35 feet), an arbitrary time representation of 384 minutes is provided by maximum bottom time circuit 30 over path MXT. Since this is the only bottom time character for which the two highest order bits are "1," assuming conventional binary encoded representations, detection of these two bits by AND gate 704 enables the extension by character generator 77 of the character "U" through gating circuit 74 to display 75. During a dive, when a depth of 35 feet is reached, the maximum allowable bottom time extended over path MXT will be less than 384 minutes, disabling AND gate 704 and thus causing gating circuit 74 to direct instead the time representation on path 732 therethrough to display 75.

Upon submerging, depth detector 11 continues to be clocked once per second by the timing signals on lead T1 to provide a current depth representation on path DEP to display 15. Also, a signal is provided on lead 112 to set flip-flop 12, the output thereof on lead BT enabling bottom time register 62. If the current depth representation on path DEP exceeds the depth in peak register 14, as indicated by comparator 13 over lead 131, peak register 14 is enabled when clocked by the timing signal on lead T3 to store therein the current depth as the new peak depth. Display 15 and peak register 14 continue to be updated in this manner once each cycle, and when the diver subsequently surfaces peak register 14 is cleared by termination of the signal on lead SUB.

The peak depth attained during the dive is extended by peak register 14 over path 141, through gating circuit 16, over path PKD to maximum bottom time circuit 30. Gating circuit 16 has been provided, along with mode switch 17 and depth entry switches 18, to permit manual depth entry for dive planning or simulation purposes. For normal automatic operation, mode switch 17 provides a signal on lead SA to gate peak depth representations on path 141 through gating circuit 16 to path PKD. When the diver is on the surface, the signal on lead SA is used also, in conjunction with the signal on lead SURF, to blank bottom time display 75 via AND gate 703 and OR gate 708. For manual operation, mode switch 17 is operated to provide a signal on lead SB, causing circuit 16 to gate therethrough depth representations entered manually via switches 18. The signal on lead SB is also reflected through AND gate 816 and OR gate 818 over lead CSF1 to circuit 30.

Gating circuit 69, mode switch 66 and surface time entry switches 68 have been provided, and function in a similar manner, for surface time simulation purposes.

The peak depth on path PKD is divided by five via divider circuit 35 and extended over path PD/5 to comparator 36 for comparison with the depth /5 entries in ROM 31. Each operation cycle the depth /5 entries in ROM 31 are scanned, sequentially from the smallest to the greatest depth, until one is found which equals or exceeds the depth representation on path PD/5. For this purpose, address register 34, which may comprise a digital counter, is incremented by the scanning signals on lead T4 through AND gate 304 to address successive entries in ROM 31; and the depth /5 portion of each addressed entry is clocked over path 311 to comparator 36 via the scanning signals on lead T5. AND gate 304 is enabled by the set output of flip-flop 32 (set by the first scanning signal on lead T6 upon submerging) coincident with the absence of a match signal on lead 362. At the same time, of course, the maximum allowable bottom time and the associated dive group address for the addressed depth are extended over paths MXT and GPA, respectively. Comparator 36 is strobed for the successive comparisons via the scanning signals on lead T6 through OR gate 306.

The dive group addresses on path GPA are loaded in turn in address register 44 until a depth /5 entry is found which equals or exceeds the peak depth representation on path PD/5. The loading of register 44 is enabled by the reset output of flip-flop 43 on lead 431, clocked by the scanning signals on lead T6 through AND gate 403.

If all of the entries in ROM 31 are scanned, as indicated by address register 34 over lead 341, and no entry is found which equals or exceeds the current peak depth representation on path PD/5, as indicated by comparator 36 over lead 361, AND gate 303 sets flip-flop 33. Indicator 305 is activated thereby to indicate that an excessive dive depth has been reached. Further incrementing of register 34 is inhibited by the signal on lead 341.

However, assume that an entry is found in ROM 31 corresponding to the peak depth representation on path PD/5. Responsive thereto, comparator 36 provides a match signal on lead 362, maintained via gate 306, which disables AND gate 304 to prevent further incrementing of register 34. The match signal on lead 362 also sets flip-flop 43, in conjunction with a scanning signal on lead T4, thereby disabling the further loading of address register 44. The set output of flip-flop 43 on lead 432 enables AND gates 404 and 405. It will be recalled that the address in register 44 at this point determines the first dive group word in ROM 41 associated with the peak dive depth. The bottom time stored at that address is read out through an output buffer of ROM 41 over path 411 via a scanning signal on lead T5 through AND gate 401, enabled by the signal on lead SUB.

Comparator 45, strobed via the low value of the scanning signals on lead T4 through gates 404 and 406, compares the elapsed bottom time representation appearing on path BOT with the allowable bottom time for the dive group on path 411. If the allowable bottom time exceeds the elapsed bottom time, comparator 45 provides a signal through AND gate 405 to lead 455. Otherwise, in the absence of a signal on lead 455 and responsive to the low value of the scanning signals on lead T6 through AND gate 403, address register 44 is incremented to address successive words in ROM 41. The associated repetitive dive group identity portion of each word is read out on path GRP.

When comparator 45 determines that the allowable bottom time read out on path 411 equals or exceeds the elapsed bottom time on path BOT, the signal on lead 455 (maintained through OR gate 406) disables AND gate 403 to prevent the further incrementing of register 44. The signal on lead 455 also enables AND gate 402 to extend the next scanning signal on lead T6 therethrough to ROM 42. The dive group identity on path GRP at that point is thus translated via the table in ROM 42 into a corresponding surface interval word address, which is extended over path NXA to surface credit circuit 50.

The above-described operation cycle is repeated each second while the diver is submerged, updating peak register 14 and depth display 15, updating the elapsed bottom time in register 62 and thus display 65, determining the maximum allowable bottom time for the particular dive depth in circuit 30, and determining the corresponding repetitive dive group in circuit 40. The elapsed bottom time on path BOT, along with the maximum bottom time on path MXT, is extended to subtractor/comparator circuit 73. Therein, the difference is determined (i.e., the remaining bottom time for the dive) and is directed over path 732 through gating circuit 74 to display 75. When the remaining bottom time decreases to 5 minutes or less, as determined by circuit 73, an output appears on lead 733 to activate warning indicator 707. Similarly, when the remaining bottom time reaches zero, an output on lead 731 sets flip-flop 78 to activate overtime indicator 705 and to blank display 75 through OR gate 708. Indicator 705 is deactivated manually by switch 785 to clear flip-flop 78.

While ascending from a dive, the rate of rise is monitored by circuit 20 and indicator 21 is activated if a predetermined allowable rate, e.g., 60 feet per minute, is exceeded. While submerged, the current depth on path DEP is clocked into register 21 once each second via the timing signals on lead T3. The depth in register 21 is then compared, during appearance of the timing signal on lead T2 in the following cycle, with the new depth on path DEP, via subtractor 22. If the previous cycle depth in register 21 exceeds the new cycle depth on path DEP by more than one (i.e., by more than 1 foot per second), a signal on lead 221 sets flip-flop 23 to activate indicator 205. Flip-flop 23 is reset at the beginning of each new cycle by the timing signal on lead T1.

Upon surfacing, depth circuit 10 disables bottom time register 62 over lead BT, enables surface time register 63, and activates indicator 605 through gate 609 enabled by flip-flop 67. Surface time register 63 begins counting the surface time, as incremented each second via the timing signals on lead T1. Indicator 605 remains activated until the surface time in register 63 equals or exceeds 10 minutes, assumed to be the minimum allowable surface time. When surface time reaches 10 minutes, flip-flop 67 is set by a signal on lead 632 through OR gate 607, deactivating indicator 605 and providing a signal on lead SURF. The signal on lead SURF clears address registers 34 and 44 via obvious paths over leads CSF and CSF1, and blanks display 75 through gates 703 and 708. The setting of flip-flop 67 also disables AND gate 401, preventing the repetitive dive group and address information on paths GRP and NXA from changing.

At this point the operation of surface credit circuit 50 is enabled. Flip-flop 52, down counter 53 and address register 54 were cleared previously via leads CSB and CSB1. Thus, the dive group identity on path GRP is registered in down counter 53 and the address on path NXA is stored in address register 54. Flip-flop 52 is set by the next scanning signal on lead T5. Successive scanning signals on lead T4 through AND gate 534 decrement counter 53 and increment register 54, the latter addressing successive entries in ROM 51. The concomitant decrementing of counter 53 obtains the repetitive dive group identity which reflects the surface time. The surface interval credit provided by each successively addressed entry is clocked, via scanning signals on lead T5, over path 511 to comparator 57 for comparison with the elapsed surface time appearing on path SFT. Comparator 57 is strobed for the successive comparisons via the scanning signals on lead T4 through AND gate 506 and OR gate 507.

When comparator 57 determines that the surface interval credit on path 511 equals or exceeds the elapsed surface time on path SFT, a signal is provided on lead 571 through AND gate 508 to lead 584. The signal on lead 584 is maintained via gate 507 and through inverter 509 disables AND gate 534, the latter preventing the further decrementing and incrementing of counter 53 and register 54. The above operations are repeated once each second while the diver is on the surface, updating surface time register 63 and determining the surface interval credit and repetitive dive group for that surface time in circuit 50.

If the diver remains on the surface for 12 hours or more, surface time register 63 will be incremented to its maximum of 720 minutes, providing an indication thereof over lead 802 to clear circuit 80. As described above, this restarts the operation of the apparatus by clearing and initializing all circuits since dives following 12 hours surface time are not considered repetitive dives.

However, assume that less than 12 hours surface time has elapsed since the previous dive. Upon submerging on a repetitive dive, the dive group identity in counter 53 is extended over path 535 to combinatorial circuit 58 to determine the address in ROM 71 of the equivalent bottom time. Since ROM 71 contains 16 entries for each dive group, the group identity multiplied by 16 in combinatorial circuit 58 can be used to indicate the address where the equivalent bottom time entries for a particular dive group begin. Further, since the entries for each repetitive dive depth in ROM 71 are assumed to start at 40 feet and increase in 10 feet increments, addressing can be further simplified by subtracting 4 from the group identity multiplied by 16 and then adding thereto the peak depth divided by 10. The result on path SFC is the address of the appropriate equivalent bottom time entry in ROM 71.

Thus, the peak depth /5 on path PD/5 is further divided by two in divider/comparator circuit 55 to provide peak depth /10 on path 555 to gating circuit 56. If the peak depth /10 is greater than 4, as indicated by circuit 55 over lead 552, then the value on path 555 is extended through gating circuit 56 on path 565 to circuit 58. Otherwise, as indicated by circuit 55 over lead 551, gating circuit 56 extends the minimum peak depth /10 value "4" from character generator 59 therethrough to path 565. Circuit 58 simply multiplies the dive group identity on path 535 by "16," subtracts "4" therefrom, and then adds the peak depth /10 on path 565 thereto, providing the result on path SFC to bottom time circuit 70. Fractional results determined in circuit 58 are assumed to be rounded to the next higher integer value on path SFC.

The equivalent bottom time entry thus addressed and read from ROM 71 (e.g., from an output buffer thereof clocked via timing signals on lead T6) is extended through gate 72 over path 725 to combinatorial circuit 73. Gate 72 is enabled for this purpose by flip-flop 76 over path 761. In circuit 73 the equivalent bottom time on path 725 is subtracted from the maximum allowable time appearing on path MXT from ROM 31, and the elapsed bottom time for the repetitive dive appearing on path BOT from register 62 is subtracted therefrom to yield the remaining bottom time for the repetitive dive. As described above, the remaining bottom time thus determined in combinatorial circuit 73 is directed over path 732 through gating circuit 74 to display 75.

By way of illustration of the above-described operation, assume a first dive to a peak depth of 50 feet for 80 minutes, a subsequent surface time of 180 minutes, followed by a second dive to a depth of 75 feet. The maximum allowable time appearing on path MXT for the first dive of 50 feet would be 100 minutes. The dive group identity appearing on path GRP from ROM 41 and stored in counter 53 when 80 minutes of bottom time elapse on the first dive would be "9" (corresponding to group J). The dive group identity in counter 53, and thus on path 535, will be decremented to "4" upon 180 minutes surface time elapsing. Circuit 58 multiplies the group identity 4 by 16 and subtracts 4 therefrom, yielding the value "60." Thus, for the second dive the peak depth /10 appearing on path 565 is "7.5" which, added to "60," yields the rounded result "68" on path 685. The equivalent bottom time read from ROM 71 at address 68 will be 23 minutes, while the maximum allowable bottom time on path MXT for the second dive will be 26 minutes. The difference of 3 minutes appearing on path 732 is the remaining bottom time at the beginning of the second dive.

Decompression Circuitry

Figure 7:
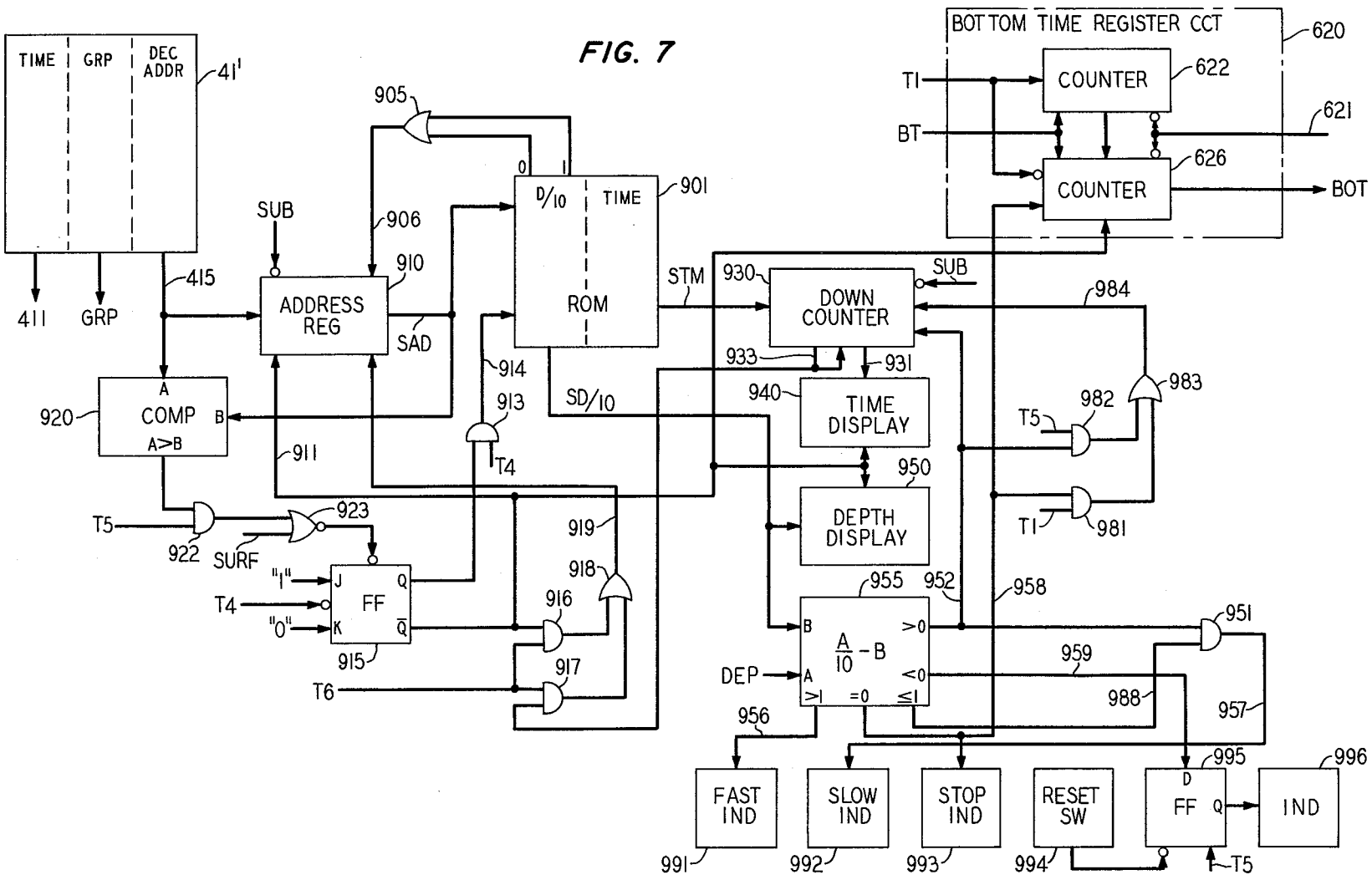
FIG. 7 is a block diagram of an illustrative embodiment of additional circuitry and modifications for use with the embodiment of FIGS. 2–4 for decompression dive ascents.

When longer bottom times are contemplated, safe subsequent ascent requires the observance of one or more decompression stops of predetermined durations, as mentioned above. FIG. 7 illustrates the manner in which the apparatus shown in FIGS. 2–4 may be modified to permit its use also for decompression ascent. Various decompression displays and indicators are provided along with an additional ROM 901, bottom time register 62 is replaced by bottom time register circuit 620, and the data in ROM's 31, 41, 42, 51 and 71 are modified slightly for decompression purposes.

Specifically, the data in ROM 41 is expanded to reflect the bottom times and the additional repetitive dive group Z set forth in a suitable decompression limit table, such as Table 1-5 in the above-identified publication. ROM 41 in FIG. 8 thus illustratively includes a total of 286 repetitive dive group words each including the maximum bottom time and group identity (now 0–15) for a particular dive group at a particular depth. The additional group identity (15) and corresponding starting address in ROM 51 for repetitive dive group Z is added in ROM 42. The 16 surface interval words for group Z are added to ROM 51; and, similarly, the 16 bottom time words for group Z are added to ROM 71, ordered in the same manner as the corresponding words for the other dive groups. Also, in ROM 31 the dive group word addresses for ROM 41' must be modified to reflect the addition of dive group Z to ROM 41'.

As shown in FIG. 7, ROM 901 is provided to store the depth and time interval for each decompression stop for the various dive depths, i.e., the data from above-mentioned Table 1-5. For example, ROM 901 may illustratively contain 325 decompression words each including a decompression stop depth divided by 10 (since the stops are in increments of 10 feet) and a time interval for the stop. The first address location in ROM 901 may contain zero stop depth and time for use during no-decompression dives. As in ROM 41', all words associated with a particular dive depth are assumed to have contiguous addresses, ordered in order of decreasing stop depth for the particular dive depth. Consequently, as depicted in FIG. 7, each word in ROM 41' further includes the starting decompression word address for the particular dive depth (i.e., the first decompression stop for that dive depth).

In general, for decompression dives the operation is substantially the same as described above for no-decompression dives, except that ROM 901 is addressed by ROM 41' at the word entry for the first decompression stop for the dive. The stop depth and time are read out to respective displays 950 and 940. Upon stopping at the particular depth, the duration of the stop is timed until the particular stop time is reached. Upon completing the stop, the ROM 901 address is incremented to display the next stop depth and time. This operation continues until the last stop (10 feet) is completed. In the case of no-decompression dives, the first word location in ROM 901 is addressed, the decompression time and depth displayed will be zero and no incrementing of the ROM 901 address occurs.

More specifically, when a word entry in ROM 41' is addressed in the manner described above, the decompression address portion of the word is directed over path 415 to address register 910 and to comparator 920. If register flag flip-flop 915 is reset, as indicated over lead 911, the decompression word address is loaded into register 910 via a signal on lead T6 through AND gate 916 and OR gate 918 over lead 919. While flip-flop 915 is reset, displays 940 and 950 are blanked by the signal on lead 911. Flip-flop 915 is subsequently set by the trailing edge of the next signal on lead T4, the output thereof through AND gate 913 (enabled during the succeeding signal on lead T4) is directed over lead 914 to clock the addressing of ROM 901 via the address in register 910. The stop depth 10 portion of the addressed word is extended over path SD/10 to display 950 and to combinatorial circuit 955. The stop time is extended over path STM to down counter 930. The next signal on lead T5 through AND gate 982 and OR gate 983 over path 984 loads the stop time into counter 930, from which it is extended over path 931 to display 940.

The address in register 910 is also directed over path SAD to comparator 920. Should the diver subsequently descend to a greater depth, the decompression address read out of ROM 901 for the greater depth will exceed that for the previous dive depth stored in register 910. An indication thereof through AND gate 922, enabled by a signal on lead T5, is directed through NOR gate 923 to reset register flag flip-flop 915. Consequently, the new decompression address on path 415 is loaded into register 910, and the new decompression stop time and depth is read out of ROM 901 and displayed via displays 940 and 950.

As the diver subsequently ascends, fast rise indicator 991 is activated until the diver arrives within 10 feet of the decompression stop depth. For the last 10 feet, slow rise indicator 992 is activated and, upon reaching the proper stop depth, stop indicator 993 is activated. For this purpose, combinatorial circuit 955 divides the depth indication from detector 11 on path DEP by a factor of 10 and then subtracts therefrom the stop depth /10 appearing on path SD/10. So long as the difference is greater than zero, a signal is provided on lead 952, enabling AND gate 982 and down counter 930 for loading therein the decompression stop time appearing on path STM. If the difference is greater than one (i.e., greater than 10 feet), a signal is provided on lead 956 to activate indicator 991. If the difference is less than one but greater than zero, AND gate 951 extends a signal on lead 957 to activate indicator 992; and if equal to zero, a stop signal is provided on lead 958 to activate indicator 993. Should the diver continue to rise beyond the stop depth, a signal will be provided on lead 959 to set flip-flop 995, the output thereof activating violation indicator 996. Indicator 996 is deactivated manually by reset switch 994.

Upon reaching the desired decompression stop depth, the signal on lead 958 also enables AND gate 981 and termination of the signal on lead 952 disables AND gate 982. This enables the decrementing of counter 930 once each second, via the timing signals on lead T1 through AND gate 981, until zero is reached. The resulting output on lead 933 inhibits the further decrementing of counter 930 and enables AND gate 917, the latter extending the next signal on lead T6 therethrough and through OR gate 918 over lead 919 to increment the address in register 910. The next decompression word entry is read out of ROM 901 and the above-described operation repeats.

When the final decompression stop for the dive is addressed, the stop depth /10 thereof will equal one (or zero in the case of no-decompression dives). An indication thereof through OR gate 905 over lead 906 inhibits the further incrementing of counter 910. Subsequently, when the diver surfaces, register 910 and counter 930 are cleared via termination of the signal on lead SUB, and flip-flop 915 is reset via the signal on lead SURF through NOR gate 923.

Since decompression stop time is not included in bottom time, normal bottom time counting is inhibited when the diver is at a decompression stop via the stop signal on lead 958. However, if the diver descends after having been at a decompression stop, bottom time counting must be restarted and the time spent at the decompression stop must be included in the bottom time. For this purpose, two bottom time counters 622 and 626 are included in register circuit 620. Counter 622 continuously registers time while the diver is submerged, operating in substantially the same manner as described above for bottom time register 62. Counter 626, on the other hand, registers bottom time only when the diver is not at a decompression stop, i.e., only when not inhibited by the signal on lead 958, and is the bottom time normally extended over path BOT. Should the diver descend from a compression stop, flip-flop 915 is reset in the manner described above. The reset output thereof on lead 911 causes the contents of counter 622 to be loaded into counter 626 and thereby extended as the total bottom time (including the decompression stop time) over path BOT. Incrementing of counter 626 resumes when flip-flop 915 is set.

It is to be understood that the above-described arrangements are merely illustrative of the principles of the invention. For example, it will be appreciated that the various ROM's can be combined in one or more memory circuits, and such memory circuits may be associative type or content addressable; the depth, bottom time and remaining time indications may be selectively activated on a common display; or micoprocessor architecture may be employed to implement the various functions described above. Numerous and varied other arrangements in accordance with the principles of the invention may be devised readily by those skilled in the art without departing from the spirit and scope of the invention.

What is claimed is:

1. Diver's apparatus comprising depth determining means including means for determining the peak depth attained during a dive, means responsive to said peak depth determination for generating a digital representation of the allowable bottom time for said dive, means for generating a digital representation of the bottom time elapsed during said dive, and means responsive to said allowable bottom time representation and said elapsed bottom time representation for generating a visual indication of the bottom time remaining for said dive.

2. Apparatus in accordance with claim 1 wherein said depth determining means further includes means for periodically determining the depth of said dive and means for generating a visual indication of said dive depth.

3. Apparatus in accordance with claim 2 further comprising means including said depth determining means for generating an alarm indication if a predetermined rate of ascent from a dive is exceeded.

4. Apparatus in accordance with claim 2 further comprising means responsive to said elapsed bottom time representation for generating a visual indication of the bottom time elapsed during said dive.

5. Apparatus in accordance with claim 4 further comprising means for generating an alarm indication if a predetermined dive depth is exceeded.

6. Apparatus in accordance with claim 1 further comprising means for generating a digital representation of the surface time elapsed between successive dives, means for generating a digital representation corresponding to a combination of the peak depth attained and bottom time elapsed during a first dive, and means responsive to said last-mentioned representation and said elapsed surface time representation for reducing the allowable bottom time for a dive succeeding said first dive.

7. Apparatus in accordance with claim 6 further comprising means for generating an indication if there is less than a predetermined interval of bottom time remaining for a dive.

8. Apparatus in accordance wih claim 7 wherein said predetermined interval of bottom time remaining is zero, said apparatus further comprising manually actuated means for clearing said last-mentioned indication.

9. Apparatus in accordance with claim 1 further comprising means operative when said bottom time remaining for said dive is zero for determining the depth and duration of a first decompression stop for ascending from said dive, means for indicating when said first decompression stop is reached, and means for indicating the time remaining for decompression at said first stop.

10. Apparatus in accordance with claim 9 further comprising means for generating an indication when the distance to said first decompression stop is less than a predetermined distance.

11. Diver's apparatus comprising first means for automatically determining and providing visual indications of the depth of a dive, second means for automatically determining and providing visual indications of the duration of said dive, third means for automatically determining the duration on the surface following said dive, and means responsive to said first, second and third means for automatically determining and providing a visual indication of the allowable bottom time for a succeeding dive.

12. Apparatus according to claim 11 further comprising decompression means including means for determining when the allowable bottom time for a dive is exceeded, means reponsive to said last-mentioned determining means for automatically determining and providing visual indications of the depth of a decompression stop for said dive, and means for automatically determining and providing visual indications of the duration of said decompression stop.

13. Apparatus according to claim 12 further comprising means for indicating when said decompression stop is reached and means for timing the duration of said decompression stop.

14. Apparatus according to claim 13 further comprising means for determining the completion of a decompression stop, and means including said decompression means responsive to said completion determining means for automatically determining and providing visual indications of the depth and duration of a succeeding decompression stop.

15. Apparatus according to claim 14 further comrising means for determining and providing an indication when the distance to a decompression stop is less than a predetermined distance.

16. In combination, means for determining the depth of a dive, means for determining the bottom time elapsed during a dive, means for determining a dive group factor corresponding to the depth and elapsed bottom time of a first dive, means for determining the surface time elapsed between said first dive and a second dive, means responsive to said dive group factor and said elapsed surface time for determining the allowable time for said second dive, and means for determining the difference between said second dive elapsed bottom time and said allowable bottom time for said second dive.

17. The combination according to claim 16 further comprising means for determining the depth and duration of a first decompression stop corresponding to said difference between the elapsed and allowable bottom times for said second dive.

18. The combination according to claim 17 further comprising means operative when said first decompression stop is completed, if said first stop is less than a predetermined depth, for determining the depth and duration of a second decompression stop.

* * * * *